US005430353A

United States Patent [19]

Feldman et al.

[11] Patent Number: 5,430,353

[45] Date of Patent: Jul. 4, 1995

[54] LAMP INLEAD ASSEMBLY HAVING A FORMED FOIL ARRANGEMENT

[75] Inventors: Joseph Feldman, Mayfield Hts.; Walter R. Chapman, Jr., Cleveland Hts.; Edward J. Collins, Painesville; Daniel L. Connell, Aurora; Gerald A. Johnson, Chagrin Falls; Benton A. Lee; William R. Walters, both of Hudson, all of Ohio

[73] Assignee: General Electric Company, Schenectady, N.Y.

[21] Appl. No.: 96,531

[22] Filed: Jul. 22, 1993

[51] Int. Cl.[6] ..... H01J 17/18

[52] U.S. Cl. ..... 313/623; 313/332; 313/624; 313/625

[58] Field of Search ..... 313/332, 623, 624, 626, 313/625, 318, 331; 345/27, 44

[56] References Cited

U.S. PATENT DOCUMENTS

| | | | |
|---|---|---|---|
| 3,105,867 | 10/1963 | Meijer | 313/332 |
| 3,515,931 | 6/1970 | Takakuwa | 313/331 |
| 3,548,245 | 12/1970 | Biscoff | 313/331 |
| 4,110,657 | 8/1978 | Sobieski | 313/332 |
| 4,254,356 | 3/1981 | Karikas | 313/332 |
| 4,851,733 | 7/1989 | Kuus et al. | 313/331 |

*Primary Examiner*—Sandra L. O'Shea
*Assistant Examiner*—Vip Patel
*Attorney, Agent, or Firm*—George E. Hawranko; Stanley C. Corwin

[57] ABSTRACT

A lamp inlead assembly for a light source having a lamp envelope with at least one end region in which the lamp inlead assembly is sealably disposed includes and outer lead wire member to which power to the light source is coupled, an inner lead wire member to which the light generating device is connected, whether incandescent or discharge, and a thin foil member disposed therebetween on which the inner and outer lead wire members are fixedly secured. The thin foil member is constructed of molybdenum and is essentially uniform in thickness throughout. At least one trough is formed in the foil member and is effective so as to: increase the surface area of the foil member and thus improve its current carrying properties without increasing the dimensional space within the end region of the lamp area to accommodate such increased surface area, provide increased rigidity for the foil member so that such foil member can be adapted for handling by high speed automated manufacturing equipment, and, with one trough centrally disposed along the width dimension of the foil member, insure that the positioning of the lead wire members relative to the foil member is maintained throughout the manufacture of both the lamp inlead assembly itself as well as the manufacture operations involving the insertion of the inlead assembly and sealing thereof into the light source.

13 Claims, 2 Drawing Sheets

Fig. 3
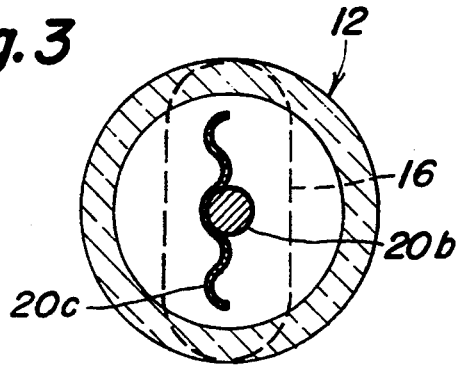
Fig. 4
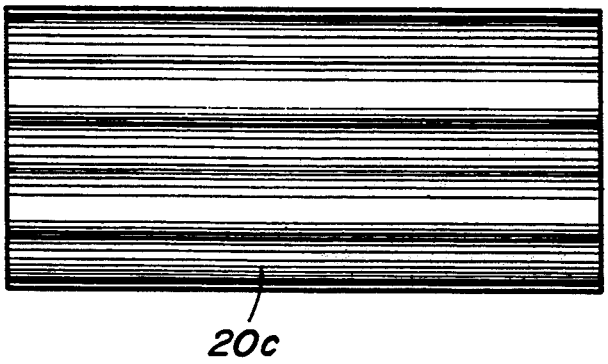
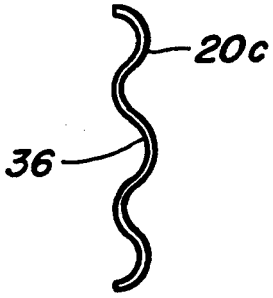
Fig. 5
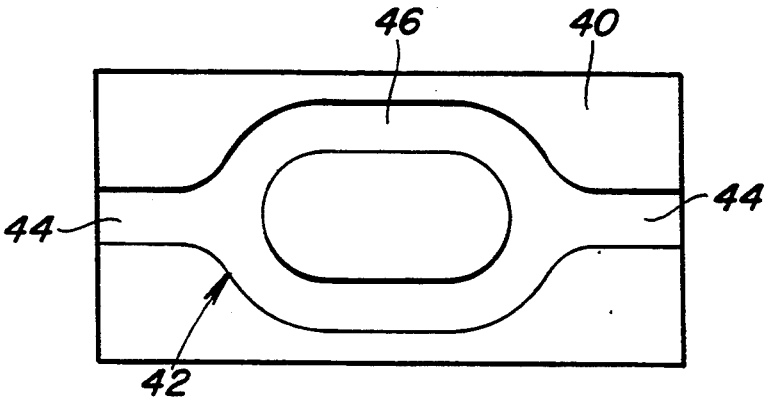
Fig. 6

LAMP INLEAD ASSEMBLY HAVING A FORMED FOIL ARRANGEMENT

FIELD OF THE INVENTION

This invention relates to a lamp inlead assembly having an improved formed molybdenum foil configuration. More particularly, this invention relates to such a lamp inlead assembly as exhibits improved stability characteristics that allow for implementation in a high speed automated manufacturing environment so as to achieve accurate positioning of the inlead assembly within the lamp without risking damage to the inlead assembly as may otherwise be caused by the manufacturing process.

BACKGROUND OF THE INVENTION

A conventional lamp inlead assembly which can be utilized for instance in a high pressure discharge lamp or a halogen filament lamp, typically includes an outer lead wire, a thin molybdenum foil and an inner lead wire. This assembly can be inserted into a double ended lamp envelope which is then pressed, or shrunk over the inlead assembly to provide a hermetic seal for the inner chamber of the lamp envelope. Typically, the molybdenum foil is extremely thin, being on the order of no more than 3 mills thick with feathered edges on either side. Though the feathered edges are effective for allowing a more complete sealing operation to be performed at the ends of the lamp envelope, such feathered edges are susceptible to damage when handled during the lamp assembly process particularly if a high speed automated manufacturing process is utilized for assembly of the lamp or the lamp inlead assembly.

One approach to avoid the handling problem for thin molybdenum foils can be found in U.S. Pat. No. 4,254,356 issued to Karikas on Mar. 3, 1991 and assigned to the same assignee as the present invention. In this patent, a Z-shaped foil configuration is utilized wherein the edges of the foil are turned outward in opposite directions thereby rendering the foil member more rigid and less susceptible to damage from indelicate handling. This approach has proven effective not only in strengthening the foil member but has done so without suffering from a reduction in the quality of the seal formed by shrinking or pressing the end of the lamp envelope around the lamp inlead assembly.

One problem that has remained however in the use of such a Z-shaped foil configuration relates to the ability to maintain the control of the positioning between the lead wires and the foil member just prior to and/or just after attachment of the lead wires to the foil member. That is, because the center portion of the Z-shaped foil member is essentially flat, maintaining the essentially round lead wire in a precise position for first welding or brazing to the foil member and then placing the entire assembly essentially centrally within the lamp envelope end prior to sealing, has proven to be difficult. For optimum lamp performance, it is essential that the inner lead wire reside on center of the lamp envelope. A lead wire that is either off center relative to the foil member or is at an angle relative to the edges of the foil member, can result in a poor seal around the lamp inlead assembly or can put stress on the connection between the lead wire and foil member such that early failure of the lamp would occur. Additionally, such a positioning error would result in electrode misalignment in a discharge lamp or an off-center filament for a Halogen-IR lamp, both of which conditions are to be avoided. Another problem associated with the Z-shaped configuration is in the manufacturing operation associated with inserting this lamp inlead assembly into a lamp envelope. For the Z-shaped arrangement, the practice has been to have the top and bottom portions of the foil member contact the inner surface of the end region of the lamp envelope. Such a contacting operation inherently slows down the manufacturing process and is less efficient than one where there was a clearance provided between the foil member and the surface of the lamp envelope.

Other approaches to solving the problem of the delicate handling requirement of the foil member so that a precise and secure seal can be formed there around, can be found in U.S. Pat. Nos. 3,582,704; 4,136,298; and, 4,851,733. In each of these patents, a foil member is utilized which has a non-uniform thickness associated therewith. In other words, the foil members have various shapes, thicknesses and various gradations in thickness to provide stability, strength and sufficient foil member dimension to insure adequate current carrying capabilities. The problem with such a variation in the thickness and shape of the foil however is that the sealing process for sealing the end of the lamp envelope around the inlead assembly containing the thicker foil member is adversely affected by the increased thickness of the foil member and the quality of such seal may suffer accordingly.

It would therefore be advantageous if an inlead assembly could be provided that would include a foil member that was thin enough to insure a proper, high quality seal at the end of the lamp envelope, could achieve such high quality seal even when utilized in a high speed automated manufacturing environment and further, could allow that the positioning between the lead wires and the foil be accurately maintained throughout the lamp manufacturing process. It would be further advantageous if such a lamp inlead assembly could accomplish all of these features while at the same time, insuring that a sufficient foil dimension control is achieved to handle the necessary current while providing additional space for clearance of the foil member during lamp manufacture.

SUMMARY OF THE INVENTION

The present invention provides a light source having a light generating means whether filament or discharge oriented disposed in a lamp envelope which can be either single ended or double ended and wherein an improved lamp inlead assembly is provided for coupling energy to the light generating means. This improved lamp inlead assembly allows for the use of an effective sealing process that can be implemented on high speed automated manufacturing equipment without risk of damage to the thin foil portion of the inlead assembly. The improved inlead assembly of the present invention also allows for the precise positioning between the lead wire portions and the foil member during the manufacturing steps of securing the lead wires to the foil and of inserting and sealing the lamp inlead assembly in the end region of the lamp envelope. Moreover, the improved lamp inlead assembly achieves this and allows for sufficient current carrying capabilities while providing additional space for clearance of the foil member during lamp manufacture.

In accordance with the principles of the present invention, there is provided a lamp inlead assembly for use with a light source having a lamp envelope and at least one end region in which the lamp inlead assembly is sealed either by shrink or press sealing. The inlead assembly includes an outer wire member which extends outward of the end region of the lamp envelope so that energy can be supplied to the light source. The inlead assembly also includes an inner wire member which extends into a chamber formed in the lamp envelope and in which light is generated either by use of a filament light source or a discharge light source. A thin foil member is disposed between the inner and outer wire members and both wire members are fixedly secured to the thin foil member. The thin foil member is of an essentially uniform thickness and has at least one trough section formed at least partially along the lengthwise direction thereof. Preferably, the at least one trough section is formed centrally along the longitudinal axis of the foil member and is sized so that portions of either or both of the inner and outer lead wire members can be disposed therein in an essentially fitted manner. This fitted relation between the lead wires and the foil member is effective so as to prevent shifting of the lead wire members relative to the foil member during assembly of the inlead assembly or insertion and sealing of the inlead assembly into the end region of the lamp. The use of a trough configuration is further effective in increasing the relative surface area of the foil member so as to insure adequate current carrying capabilities without increasing the necessary space requirements for such foil member and furthermore, simultaneously achieves a more rigid construction for such inlead assembly.

BRIEF DESCRIPTION OF THE DRAWINGS

In the following detailed description, reference will be made to the attached drawings in which:

FIG. 3 is a side sectional view of the light source of either FIG. 1 or FIG. 2 taken along sections a—a showing the inlead assembly constructed in accordance with the present invention.

FIG. 4 is an elevational view of the foil member portion of the inlead assembly of the present invention.

FIG. 5 is a side elevational view of the foil member of FIG. 4.

FIG. 6 is an elevational view of a foil member constructed in accordance with an alternate embodiment of the present invention.

DETAILED DESCRIPTION AND OPERATION

Figure 1:
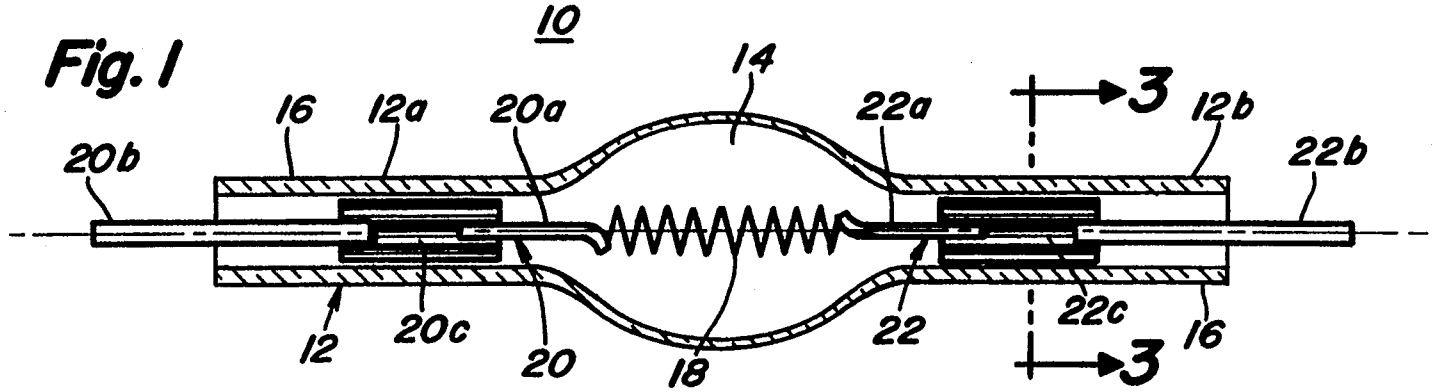
FIG. 1 is an elevational view in section of a first light source type having the improved inlead assembly of the present invention disposed therein.

As seen in FIG. 1, a light source 10 is illustrated having a lamp envelope 12 with a central portion having a chamber 14 formed therein and two opposite ended tubular end portions 16. The light source 10 of FIG. 1 is an incandescent light source having a filament member 18 disposed along the central, or longitudinal axis of the lamp envelope 12. Connected to opposite ends of filament 18 are respective first and second lamp inlead assemblies 20, 22. Lamp inlead assemblies 20, 22 include respective inner lead wire members **20*a*, 22*a* which are connected to the ends of the filament 18, outer lead wire members 20*b*, 22*b* which extend outward from the end region of the lamp envelope 12 so that power can be connected to the light source 10, and, thin foil members 20*c*, 22*c*** which are constructed of molybdenum and are typically on the order of approximately 1 mill in thickness but in some extreme cases, can be as high as 3 mills.

The lamp inlead assemblies 20, 22 are disposed in the end regions **12*a*, 12*b* of the lamp envelope 12 and, during one of the last steps in the lamp manufacturing process, are hermetically sealed in these end regions 12*a*, 12*b* either by a heat shrinking or a pressing/pinching process as are common in the field. Although the light source 10 is shown as a double ended light source, it is possible to utilize the improved lamp inlead assemblies 20, 22** of the present invention in a single ended light source where such single end is wider to accommodate insertion of two lamp inlead assemblies in a side by side physical relationship.

In a typical commercial application of the filament based light source 10 as shown in FIG. 1, a coating is placed on the surface of the lamp envelope 12 so as to cause infrared radiation (IR) given off by the filament 18 to be reflected back to the filament 18 thereby improving the energy efficiency of this type of light source 10. This type of light source has been available from General Electric Company's Lighting Business as their Halogen-IR (TM)light source. For a discussion of the operation of such a lamp, reference is hereby made to U.S. Pat. No. 4,810,932 issued to Ahlgren et al on Mar. 7, 1989 and assigned to the same assignee as the present invention. One of the key features of the Halogen-IR lamp in attaining its improved energy efficiency is in the central placement of the filament 18 along the longitudinal axis of the lamp envelope 12 which allows for absorbing as much of the reflected IR back into the filament 18 as possible. To attain this centralized placement of the filament 18 within the lamp envelope 12, it is necessary to maintain accurate control over the positioning of the inner and outer lead wire members **20*a*, 20*b*, and 22*a*, 22*b* relative to the respective thin foil members 20*c*, 22*c*. In addition to maintaining the positioning of the lead wire members during the steps associated with assembling of the lamp inlead assemblies 20, 22, it is also necessary to maintain the positioning of the lamp inlead assemblies 20, 22 during the steps associated with the insertion of the filament 18, inlead assembly 20, 22 configuration into the lamp envelope 12 for sealing therein. Such position accuracy during the sealing process is necessary to insure that the filament resides as closely as possible to the central longitudinal axis of the lamp envelope 12. These positioning control considerations will be discussed in further detail with respect to FIGS. 3 through 6**.

Figure 2:
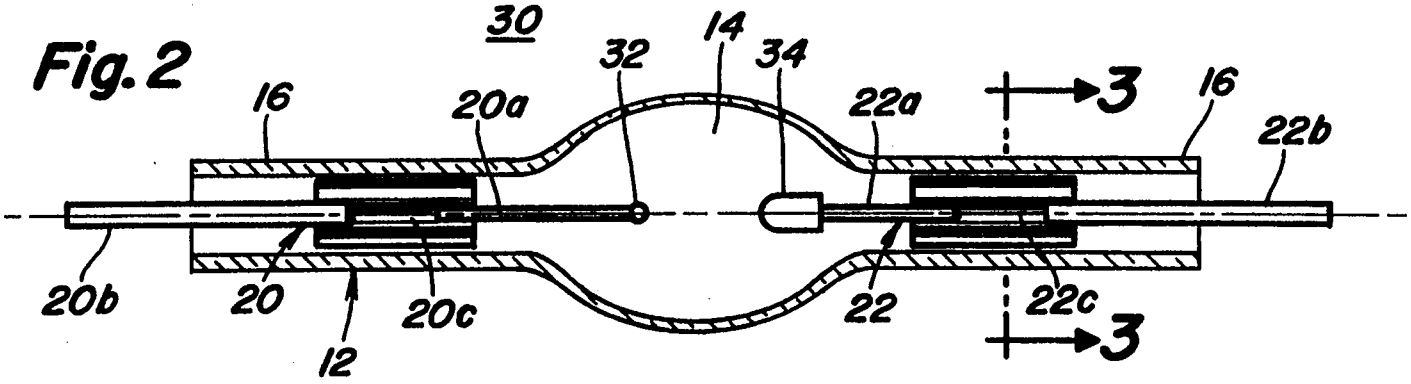
FIG. 2 is an elevational view in section of a second light source type having the improved inlead assembly of the present invention disposed therein.

The light source 30 shown in FIG. 2 is identical to that shown in FIG. 1 except that, instead of a filament 18 serving as the light generating element, light source 30 is a discharge light source which utilizes spaced apart electrodes 32, 34 as a means for generating light output. As shown in FIG. 2, the two electrodes 32, 34 are different in size with the anode member 34 being larger than the cathode member 32 as is the typical case in running such a discharge lamp 30 using a DC energy source. It is to be understood that the present invention would apply equally as well with a discharge lamp that is powered from an AC source. Another difference between the light source 30 of FIG. 2 and that of FIG. 1 is in the lengths of the respective inner lead wire members **20*a*, 22*a*. It can be seen that since the electrodes 32, 34 are of a different length, it is necessary to alter the lengths of the inner lead wire members 20*a*, 20*b* so that the resulting arc discharge will reside essentially at the center region of the chamber 14 of the lamp envelope 12**.

As in the requirement that the filament 18 of the light source 10 shown in FIG. 1 reside substantially along the longitudinal axis of the lamp envelope 12, a similar requirement is also necessary with respect to applying the lamp inlead assemblies 20, 22 of the present invention to the discharge light source 30 as shown in FIG. 3. Because the arc discharge (not shown) of the discharge light source 30 has high thermal operating characteristics associated therewith, it is necessary to maintain the electrodes 32, 34 at a substantially central position within the chamber 14 so that the arc discharge does not contact the walls of the lamp envelope 12. Accordingly, the previous discussion regarding the control over the positioning of the inner and outer lead wires 20*a*, 20*b*, 22*a*, 22*b* relative to the foil members 20*c*, 22*c* and of the positioning of the entire lamp inlead assemblies 20, 22 within the lamp envelope 12 is pertinent here as well.

As seen in FIG. 3, a cross-sectional view taken along line 3—3 from either FIG. 1 or FIG. 2, illustrates one of the end regions 16 of the lamp envelope 12 including the configuration between the foil members 20*c*, 22*c* and the inner and outer lead wire members 20*a*, 22*a*, 20*b*, 22*b* that allows for the precise control of the positioning between components as was discussed hereinabove. As can be seen by the shaded area of FIG. 3, the end region 16 of the lamp envelope 12 is sealed around the lamp inlead assembly 20 or 22 in a manner so as to hermetically seal the chamber 14 formed in the lamp envelope 12. The sealing process can be of any conventional type for light sources, such as by means of a heat shrinking process or a pinch/press process.

It is known that the integrity of the seal at the end region 16 of the lamp envelope 12 depends largely on the thickness of the foil member 20*c*, 22*c*. Typically, the foil member 20*c*, 22*c* has a thickness on the order of approximately 1 mill with the edges being feathered even thinner to allow for a more secure seal. With this thickness however, the thin foil member 20*c*, 22*c* is susceptible to damage particularly when used with high speed automated manufacturing equipment (not shown) which includes devices for handling the thin foil member 20*c*, 22*c* that are not delicate in nature. Accordingly, to allow easy adaptation of lamp inlead assemblies into high speed manufacturing systems, the thin foil member 20*c*, 22*c* of the present invention achieves a greater strength and rigidity than would otherwise be attainable for such a thin material without the need to increase the thickness at any point and incur a design tradeoff penalty in the form of a less secure seal. As seen in FIG. 3, the thin foil members 20*c*, 22*c* maintain essentially the same uniform thickness and foil surface width as a conventional thin foil but is strengthened by way of the troughs 36 that are formed lengthwise on the foil members 20*c*, 22*c* (extending into the drawing when viewed from FIG. 3). Additionally, even given this greater surface area, the foil member 20*c*, 22*c* construction of the present invention still allows for a cross-wise dimension or width whereby a clearance exists between the feathered edges of the foil member 20*c*, 22*c* and the inner wall surfaces of the lamp envelope 12. By this clearance arrangement, the present invention provides a more easily adapted high speed automated assembly capability since there is no risk of the foil member catching or otherwise binding up during the manufacturing stage of pulling the inlead assembly into the lamp envelope. As such, the manufacturing process can be conducted at a faster rate than could be achieved using an inlead assembly that was in contact with the lamp envelope. Moreover, it can be appreciated that this clearance feature allows for less expensive automated equipment since the tolerances on the tooling used to align and insert the inlead assembly into the lamp envelope can be relaxed.

Disposed in a centrally located trough 36 is a portion of one of the inner or outer lead wire members 20*a*, 22*a*, 20*b*, 22*b*. The curved dimension of this central trough 36 is selected so as to closely coincide with the diameter of the lead wires so that the inner and outer lead wires 20*a*, 22*a*, 20*b*, 22*b* can rest within the trough 36 in an essentially nested manner. In this manner, it can be appreciated that securing the lead wire to the thin foil 20*c*, 22*c* for purposes of controlling the positioning of such components relative to one another, can be accurately achieved. Once the lead wire member has been positioned within the trough 36 of the foil member 20*c*, 22*c*, the lead wire member can be secured thereto using known techniques such as welding or brazing.

As further seen in FIG. 3, the curvilinear dimensions of the various troughs (central and outer) can differ thereby providing a recognizable distinction between the troughs 36 that may be utilized in high speed automated equipment to verify that the lead wire member does in fact sit within the proper trough 36. Additionally, it can be appreciated that although the foil member 20*c*, 22*c* shown in FIG. 3 includes three troughs 36, it is possible to practice the principles of the present invention by the use of an alternate number of troughs, such alternate arrangement being contemplated as within the scope of the present invention.

FIGS. 4 and 5 illustrate further views of the foil member 20*c*, 22*c* alone and indicate that the troughs 36 can be pressed into the foil member 20*c*, 22*c* along the entire length of the foil member. There are several advantages to this approach; one is, a greater surface area is achieved so that adequate current carrying capabilities are achieved without adding to the dimensional requirements needed to accommodate other larger foil members as shown in the prior art. Secondly, with the troughs 36 extending the length of the foil members 20*c*, 22*c*, the tolerance in the length of the lead wire members can be relaxed thereby allowing the lead wires to extend further onto the foil member without experiencing drifting away from the central position. Also in this manner, it can be appreciated that the process for constructing the foil members 20*c*, 22*c* can be automated thereby making the cost of such a device very similar to that of a flat foil configuration.

As seen in FIG. 6, an alternate embodiment for the foil member 40 portion of the lamp inlead assembly 20, 22 can provide for a trough arrangement 42 which does not extend in a straight manner for the length of this foil member 40. Instead, foil member 40 includes a trough arrangement 42 having end straight portions 44 and an inner oval portion 46 connected thereto to form one continuous path along the length of the foil member 40. Similar to the foil member configuration illustrated in figs. 4 and 5, the foil member 40 shown in FIG. 6 allows for the same control over the positioning of the lead wire members relative to the foil member 40. Additionally, because of the oval configuration of the inner trough portion 46 of foil member 40, it can be appreciated that the strength of this foil member 40 has been increased when measured from a side to side dimension as well as having been maintained when measured from an end to end dimension.

With this trough arrangement as shown in both foil member configurations, the dimensional control of the entire lamp inlead assembly 20, 22, together with the light source arrangement whether incandescent or discharge, when such configuration is being inserted into the lamp envelope 12 for one of the final steps in the lamp assembly/manufacture, is accurately maintained. The trough configuration for the foil members shown in FIGS. 4 through 6 insure that there is control over the flat, two-dimensional nature of this assembly. In other words, the trough configurations are effective for preventing the lamp inlead assembly 20 or 22 from sagging during lamp assembly.

Although the hereinabove described embodiment of the invention constitutes the preferred embodiment, it should be understood that modifications can be made thereto without departing from the scope of the invention as set forth in the appended claims. For instance, instead of the oval shaped inner trough portion 46 shown in FIG. 6, it would be possible to utilize an S-shaped inner trough portion, or some other shape that resulted in increased rigidity of the foil member, and still practice the principles of the present invention. Additionally, although the trough sections of the present invention are shown having an arcuate or rounded shape with an essentially uniform radius and pitch characteristics as well as having a symmetrical waveshape associated therewith, it is not intended that this invention be limited to such a configuration. It is possible to modify the pitch and radii of the trough sections and/or to utilize a non-symmetrical waveshape and still practice the present invention.

We claim:

1. A lamp inlead assembly for a light source having a lamp envelope with at least one end region in which said lamp inlead assembly is sealably disposed, said lamp inlead assembly comprising:

an outer lead wire member which partially extends outward of the end region of said lamp envelope so as to allow coupling of energy to said light source;

an inner lead wire member which partially extends inward to a chamber formed in said lamp envelope;

a foil member disposed between said outer lead wire member and said inner lead wire member, said inner and outer lead wire members being fixedly secured to said foil member;

wherein said foil member is constructed having an essentially uniform thickness associated therewith; and wherein said foil member has at least one trough section formed therein, said at least one trough section extending at least partially along the lengthwise dimension of said foil member and being effective such that, portions of at least one of said inner and said outer lead wire members are disposed therein in a fitted manner.

2. The lamp inlead assembly as set forth in claim 1 wherein edges of said foil member are feathered so as to insure an adequate seal of said at least one end region around said lamp inlead assembly.

3. The lamp inlead assembly as set forth in claim 1 wherein a plurality of trough sections are provided and extend in a straight line for the length of said foil member.

4. The lamp inlead assembly as set forth in claim 3 wherein said plurality of trough sections includes a center trough section formed at the midpoint along the width of said foil member, and a plurality of outer trough sections formed symmetrically about said center trough section, said inner and outer lead wire members being disposed in said center trough section.

5. The lamp inlead assembly as set forth in claim 3 wherein said plurality of trough sections include outer, straight trough sections and an inner, curved trough section; said outer straight trough sections being formed at approximately the midpoint along the width of said foil member and having said inner and outer lead wire members disposed therein.

6. The lamp inlead assembly as set forth in claim 5 wherein said center curved trough section is oval shaped and said outer straight trough sections connect into said oval-shaped inner trough section in a continuous manner.

7. A light source having an improved lamp inlead assembly disposed therein, said light source comprising:

a lamp envelope made of a light transmissive material, having a chamber formed therein and further having at least one end region associated therewith;

light generating means disposed within said chamber and effective upon energization thereof, for generating light output;

a pair of lamp inlead assemblies extending through said at least one end region of said lamp envelope and effective so that energy can be coupled to said light generating means;

said pair of lamp inlead assemblies including respective outer lead wire members, inner lead wire members and thin foil members interconnected between said respective inner and outer lead wire members;

wherein said respective thin foil members are constructed having an essentially uniform thickness associated therewith; and wherein said respective thin foil members each have at least one trough section extending at least partially along the lengthwise dimension thereof and being effective so that, portions of at least one of said respective inner and outer lead wire members are disposed therein in a nested manner.

8. The light source as set forth in claim 7 wherein edges of said foil member are feathered so as to insure an adequate seal of said at least one end region around said lamp inlead assembly.

9. The light source as set forth in claim 7 wherein a plurality of trough sections are provided and extend in a straight line for the length of said foil member.

10. The light source as set forth in claim 9 wherein said plurality of trough sections includes a center trough section formed at the midpoint along the width of said foil member, and a plurality of outer trough sections formed symmetrically about said center trough section, said inner and outer lead wire members being disposed in said center trough section.

11. The light source as set forth in claim 9 wherein said plurality of trough sections include outer, straight trough sections and an inner, curved trough section; said outer straight trough sections being formed at approximately the midpoint along the width of said foil member and having said inner and outer lead wire members disposed therein and wherein said center curved trough section is oval shaped and said outer straight trough sections connect into said oval-shaped inner trough section in a continuous manner.

12. The light source as set forth in claim 7 wherein said light generating means includes a filament member on which said respective inner lead wire members of said pair of lamp inlead assemblies are connected at opposite ends thereof.

13. The light source as set forth in claim 7 wherein said light generating means includes a pair of electrodes across which an arc discharge is generated upon excitation of said light source, said respective inner lead wire members of said pair of lamp inlead assemblies being connected respectively to a corresponding one of said electrode members.

* * * * *